United States Patent [19]

Gleason

[11] Patent Number: 5,005,744

[45] Date of Patent: Apr. 9, 1991

[54] ADJUSTABLE BACKPACK

[76] Inventor: Dana W. Gleason, 409 East Olive, Bozeman, Mont. 59715

[21] Appl. No.: 562,322

[22] Filed: Aug. 3, 1990

[51] Int. Cl.[5] ..... A45F 3/08

[52] U.S. Cl. ..... 224/211; 224/209; 224/901

[58] Field of Search ..... 224/209, 210, 211, 212, 224/215, 259, 261, 262, 901

[56] References Cited

U.S. PATENT DOCUMENTS

| | | | |
|---|---|---|---|
| 2,611,519 | 3/1949 | Utterström | 224/211 |
| 3,265,260 | 8/1966 | Romney | 224/212 |
| 4,082,208 | 4/1978 | Lane, Jr. | 224/209 |
| 4,356,942 | 11/1982 | Hayes | 224/211 |
| 4,744,398 | 5/1988 | Clark | 224/209 |
| 4,811,768 | 3/1989 | Williams | 224/901 |

*Primary Examiner*—Linda J. Sholl

*Attorney, Agent, or Firm*—Richard C. Conover

[57] ABSTRACT

A backpack including a stiffened but bendable planar element which is held in a pocket secured to the backpack bag to provide a flexible pack frame. The pack frame supports a VELCRO portion located on the side of the frame adjacent the backpack bag forming one side of a second pocket sized to receive the ends of a pair of shoulder straps for holding the backpack bag. The two shoulder straps are provided with corresponding VELCRO portions at the ends to be inserted into the second pocket for gripping the VELCRO associated with the pack frame. Further, each shoulder strap has a stiffening element sewn inside the strap adjacent the portion where the VELCRO of the strap is located which assists the gripping action of the VELCRO when the backpack bag is carried by a user.

4 Claims, 5 Drawing Sheets

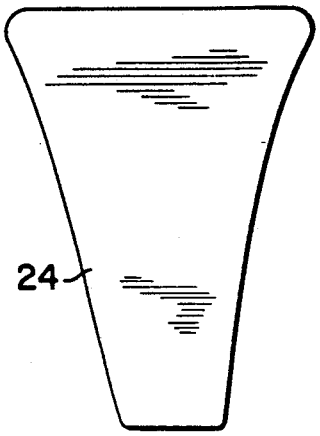
FIG. 4
FIG. 5
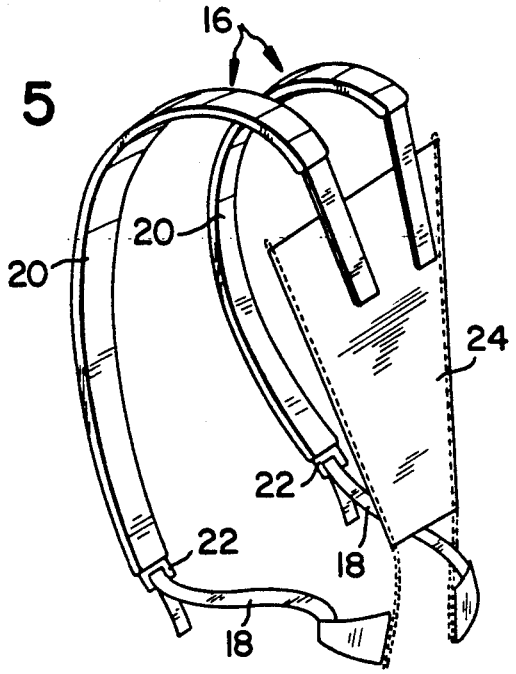
FIG. 7
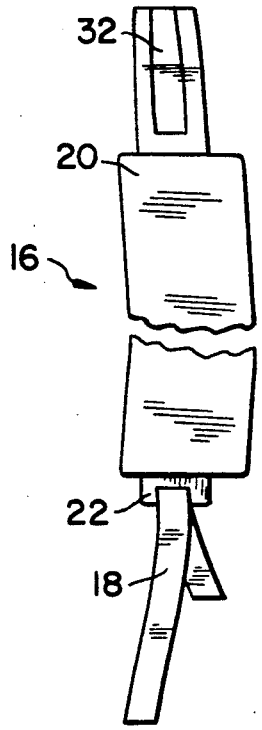

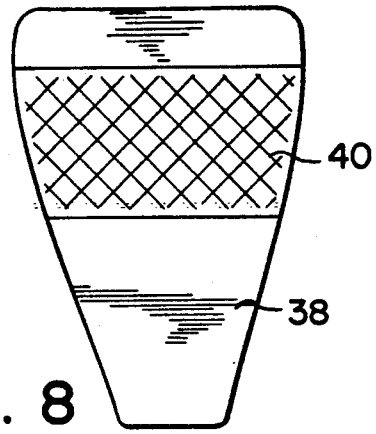
FIG. 8
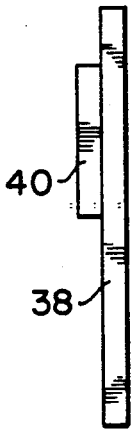
FIG. 9
FIG. 10
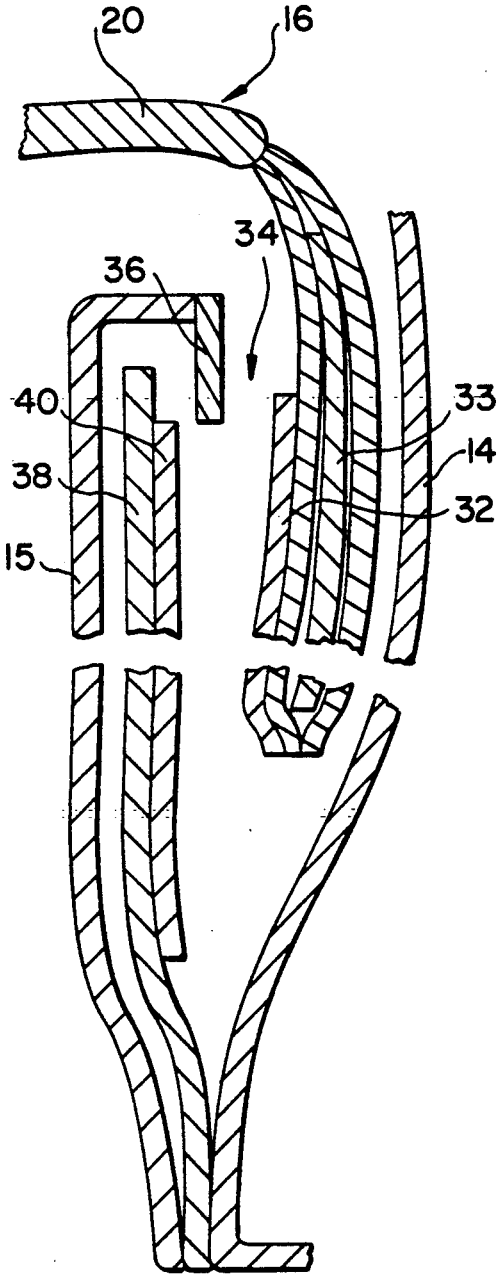

ADJUSTABLE BACKPACK

BACKGROUND OF THE INVENTION

This invention relates to an improved backpack having a "soft" pack frame and in particular to a backpack wherein the shoulder straps can be positioned in the directions in which they extend over a user's shoulder to accommodate users of different sizes.

Conventional backpacks generally have rigid, tubular frames which are used to support the backpack bag. The shoulder straps are secured to the top of the frame and the bottom of the frame and extend over the user's shoulder so the user can support the pack bag on his or her back. The shoulder straps, with these conventional backpacks, are secured at a generally central position at the top of the bag and extend angularly, outwardly to accommodate the user. A length adjustment for these backpack shoulder straps is generally made with buckles adjustably connecting two portions of the straps.

A need exists for a backpack having a comfortable pack frame in combination with shoulder straps which are easily adjustable to accommodate users of different sizes.

SUMMARY OF INVENTION

The present invention includes a backpack frame constructed of a stiffened but yet bendable planar element which is held in a pocket secured to the backpack bag. The backpack frame supports a VELCRO (loop and hook fasteners) portion located on the side of the frame adjacent the backpack bag and forming one side of a second pocket sized to receive the ends of the shoulder straps. Two shoulder straps are provided with a VELCRO portion at the ends to be inserted into the second pocket for gripping the VELCRO associated with the backpack frame. Further, each shoulder strap has a stiffening element sewn inside the strap adjacent the portion where the VELCRO of the strap is located. This stiffening element assists the gripping action of the VELCRO when the backpack bag is carried by a user. The shoulder straps secure the backpack bag to the user and are easily removed and reinserted at a different position to accommodate users of different sizes.

BRIEF DESCRIPTION OF THE DRAWINGS

In order that the invention may be clearly understood and readily carried into effect, preferred embodiments of the invention will now be described, by way of example only, with reference to the accompanying drawings wherein:

FIG. 4 is an elevational view of the flexible backpack frame member;

FIG. 5 is a perspective view of the adjustable backpack frame together with shoulder straps with the backpack bag removed;

FIG. 7 is perspective view of a shoulder strap of the present invention;

FIG. 8 is an elevational view of a flexible backpack frame member according to a second embodiment of the present invention;

FIG. 9 is a side view of the backpack planar member shown in FIG. 8; and FIG. 10 is an exploded partial cross-sectional view of a second embodiment of the present invention taken along the line 6—6 in FIG. 3 using the backpack frame shown in FIG. 8.

DETAILED DESCRIPTION OF PREFERRED EMBODIMENT

Figure 1:
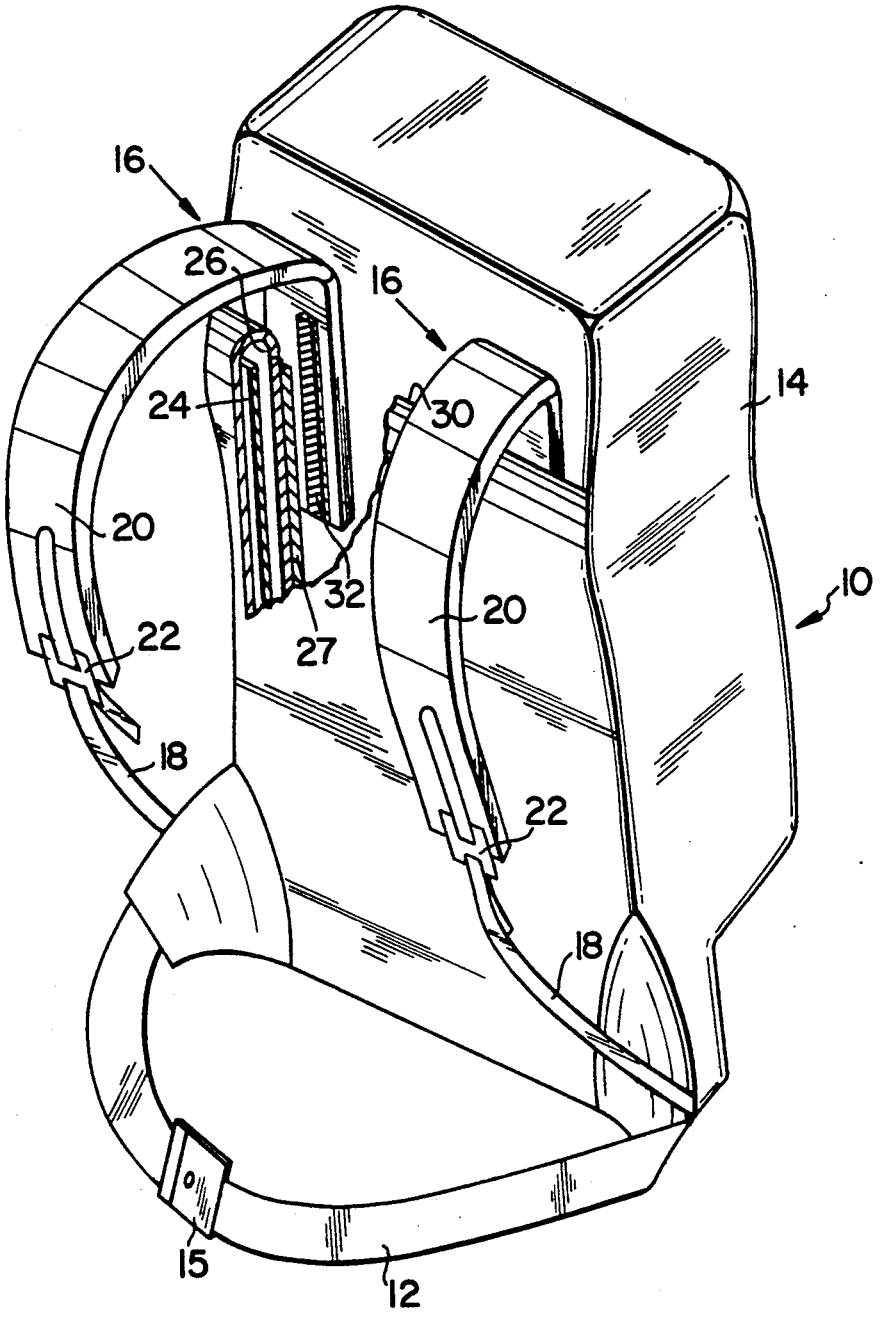
FIG. 1 is a perspective view of a backpack incorporating the present invention with parts broken away.
Figure 2:
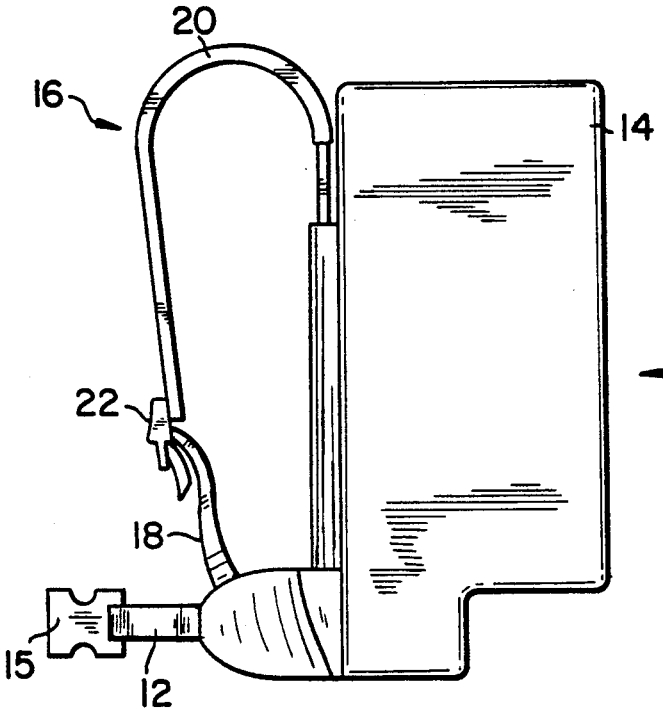
FIG. 2 is a side view of the backpack shown in FIG. 1.
Figure 3:
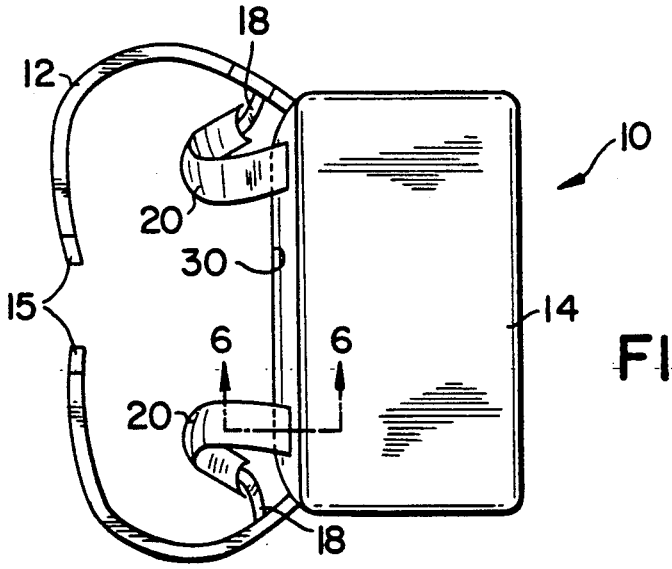
FIG. 3 is a top view of the backpack shown in FIG. 1.

A backpack 10 incorporating the present invention is shown in FIG. 1. Backpack 10 includes a conventional waist strap 12, connected to a backpack bag 14, the waist strap having two portions connected together with a releasable buckle 15. A pair of shoulder straps 16 are each connected to the backpack bag 14 adjacent the bottom edges of backpack bag 14 as shown in FIG. 1, each of which shoulder strap includes a strap portion 18 and shoulder pad portion 20. Buckles 22 releasably connect strap portion 18 to pad portion 20 to permit shoulder straps 16 to be lengthened or shortened as necessary.

Figure 6:
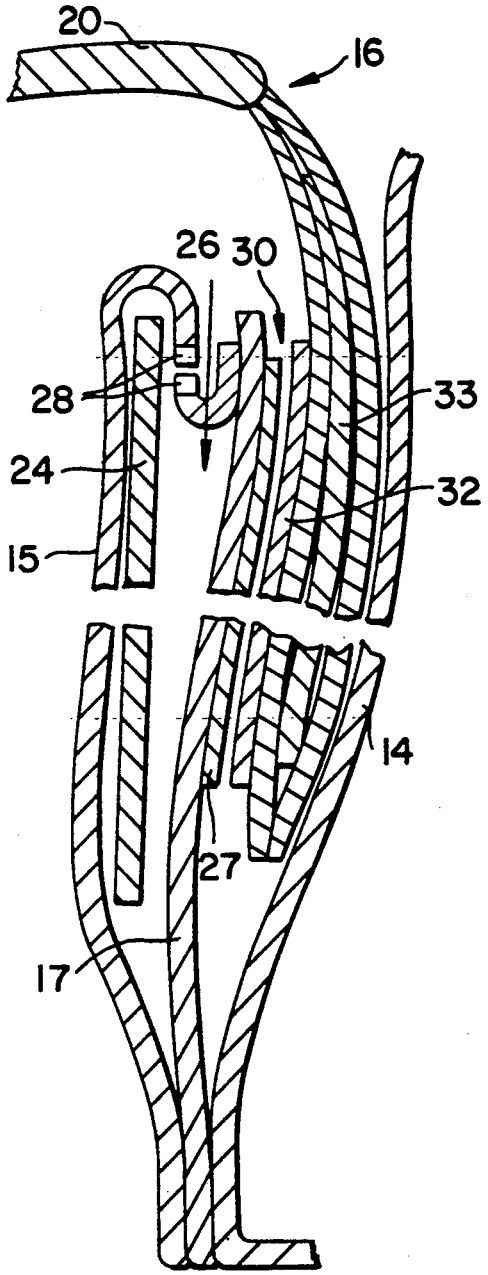
FIG. 6 is an exploded cross-sectional view of one embodiment of the present invention taken along the line 6—6 in FIG. 3.

A backpack frame member 24 constructed of a stiffened, but bendable, planar member is shown in FIG. 1 and FIG. 4 and is positioned as shown in FIG. 1 to support the backpack bag 14. The backpack frame member 24 may be constructed of a stiffened plastic material, for example, and provides support for carrying the backpack bag 14. The backpack frame 24 is positioned in a pocket 26 which is integrally formed or sewn to the backpack bag 14 as shown in FIG. 6. The pocket 26 is open at the top and is formed of first pocket member 15 and second pocket member 17 sewn to backpack bag 14, as shown in FIG. 6. The upper opening of pocket 26 may be closed with a zipper 28 to secure the frame member 24 in the pocket 26, as shown in FIG. 6. The side of pocket member 17 adjacent the backpack bag 14 is provided with a VELCRO surface 27 which forms one side of a second pocket 30 formed between second pocket member 17 and backpack bag 14, as shown in FIG. 6.

Shoulder straps 16 include a VELCRO strip 32 provided at the end of straps 16 beyond the shoulder pads 20. When this end of straps 16 is inserted into the second pocket 30, the VELCRO surfaces 27 and 32 mate to connect the two VELCRO surfaces together. The shoulder straps 16 further include a stiffener element 33, as shown in FIG. 6, which in a preferred embodiment, is sewn inside the shoulder straps 16 where the VELCRO is located to enhance the gripping action of the VELCRO strip 32 and VELCRO surface 27.

With this arrangement, each shoulder strap can be inserted deeper into the second pocket 30 or positioned from side to side on the VELCRO surface 27 of pocket 30 to adjust the angular orientation of each strap with respect to each other to accommodate users of different sizes.

A second embodiment of the present invention is shown in FIG. 10. In this embodiment, no pocket 26 is provided. Instead, a single pocket 34 is provided on backpack bag 14, which pocket 34 is provided with pocket member 15 and a flap 36 for securing a modified pack frame member 38 within the pocket 34 as shown in FIG. 10. This modified frame member 38 has a VELCRO upper portion 40 as shown in FIG. 8. The shoulder straps 16 each having a VELCRO strip 32 are inserted into the pocket 34. The VELCRO strip of the shoulder straps 16 engages the VELCRO portion 40 of frame member 38 permitting a user to orient the straps in any desired position.

Thus, it can be seen that with either embodiment of the present invention, shoulder straps 16 are inserted in a pocket where shoulder straps 16 having a VELCRO strip attached are secured to a planar backpack frame member having an associated VELCRO portion. With this arrangement, shoulder straps 16 can be easily changed in distance apart or in angular orientation with each other in order to accommodate users of different sizes or to shift the shoulder straps from a pressure point as the pack is being carried.

While the fundamental novel features of the invention have been shown and described, it should be understood that various substitutions, modifications and variations may be made by those skilled in the art without departing from the spirit or scope of the invention. Accordingly, all such modifications or variations are included in the scope of the invention as defined by the following claims.

I claim:

1. A backpack carried on the back of a user comprising:

a planar frame member constructed of a stiffened but bendable material;

a backpack bag;

a first pocket secured to a side of the backpack bag adjacent the user having an open upper portion for receiving the planar frame member and being formed between a first pocket member and a second pocket member;

a securing means for securing the planar frame member in the first pocket;

the second pocket member of the first pocket forming one side of a second pocket between the second pocket member and the backpack bag and wherein this second pocket member includes a VELCRO surface located on the side of the second pocket member closest the backpack bag;

a shoulder strap having one end connected to the backpack bag at a lower end thereof and having a VELCRO strip positioned at the other end of the shoulder strap;

the second pocket being sized to receive the VELCRO end of the shoulder strap, whereby the VELCRO end of the shoulder strap is positioned to engage the VELCRO surface of the second pocket member to securely hold the shoulder strap end within the second pocket.

2. A backpack according to claim 1 wherein the shoulder strap further includes a stiffening element located at the end of the shoulder strap adjacent the VELCRO strip.

3. A backpack carried on the back of a user comprising:

a backpack bag;

a planar frame member being constructed of stiffened but bendable material and having a VELCRO portion;

a pocket located on the back side of the backpack bag between the backpack bag and the user, the pocket having an open upper end;

the pocket being sized to receive the planar frame member;

a retaining means located at the open end of the pocket for retaining the planar frame member within the pocket;

a shoulder strap having one end secured to the backpack bag at the lower end of the backpack bag and having a VELCRO strip secured to the shoulder strap at a second end thereof;

the pocket being further sized and positioned to receive the VELCRO end of the shoulder strap so that the VELCRO strip and VELCRO portion engage one another to securely hold the shoulder strap end within the pocket.

4. A backpack according to claim 3 wherein the shoulder strap further includes a stiffening element located at the end of the shoulder strap adjacent the VELCRO strip.

* * * * *